US006117204A

United States Patent [19]

Saito et al.

[11] Patent Number: 6,117,204

[45] Date of Patent: Sep. 12, 2000

[54] SINTERED TITANIUM ALLOY MATERIAL AND PROCESS FOR PRODUCING THE SAME

[75] Inventors: Takashi Saito; Tadahiko Furuta; Hiroyuki Takamiya, all of Aichi, Japan

[73] Assignee: Kabushiki Kaisha Toyota Chuo Kenkyusho, Aichi-gun, Japan

[21] Appl. No.: 09/153,911

[22] Filed: Sep. 16, 1998

[30] Foreign Application Priority Data

Sep. 16, 1997 [JP] Japan ..... 9-250811

[51] Int. Cl.[7] ..... C22C 14/00

[52] U.S. Cl. ..... 75/245; 75/244; 419/12; 419/38

[58] Field of Search ..... 75/244, 245; 419/12, 419/38

[56] References Cited

U.S. PATENT DOCUMENTS

| | | | |
|---|---|---|---|
| 3,379,522 | 4/1968 | Vordahl . | |
| 5,409,518 | 4/1995 | Saito et al. | 75/244 |
| 5,520,879 | 5/1996 | Saito et al. | 419/38 |
| 5,534,353 | 7/1996 | Kaba et al. | 428/552 |

FOREIGN PATENT DOCUMENTS

| | | |
|---|---|---|
| 1-29864 | 6/1989 | Japan . |
| 5-5142 | 1/1993 | Japan . |
| 5-171321 | 7/1993 | Japan . |

*Primary Examiner*—Ngoclan Mai

*Attorney, Agent, or Firm*—Oblon, Spivak, McClelland, Maier & Neustadt, P.C.

[57] ABSTRACT

A sintered Ti alloy material and a process for producing the same, which comprises a matrix mainly comprising a Ti alloy, and TiB dispersed and maintained in said matrix, wherein a composition of the sintered Ti alloy material at least comprises from 0.1 to 8.0% by weight of B, from 3.0 to 30.0% by weight of Mo, 50% by weight or more of Ti, and the balance of unavoidable impurities.

15 Claims, 7 Drawing Sheets

20 μm

SINTERED TITANIUM ALLOY MATERIAL AND PROCESS FOR PRODUCING THE SAME

FIELD OF THE INVENTION

The present invention relates to a sintered titanium alloy material, and more particularly, it relates to a sintered titanium alloy material that has excellent characteristics such as high density, high rigidity, high strength and high wear resistance, and is suitable as various parts such as high strength parts.

BACKGROUND OF THE INVENTION

A titanium (Ti) alloy has been used as high strength parts in the fields of military apparatuses, space developments, aircraft and racing cars, owing to its high specific strength and high specific toughness. However, it has been considered that the Ti alloy is difficult to be used for mass-produced parts for reasons such as high cost of raw materials, difficulty in melting and casting, and poor in yield.

Recently, a sintered Ti alloy material has been developed that solves the high cost and low productivity of the Ti alloy, and realizes high strength and high fatigue strength. For example, a Ti-based composite material composed of a matrix of an α-type, α+β-type or β-type Ti alloy and from 5 to 50% by volume of a TiB solid solution, and its production process are reported in Japanese Unexamined Patent Publication No. 5-5142. In this process, a TiB solid solution, which is inherently difficult to react with a Ti alloy, is selected as reinforcing particles, so as to improve the strength, rigidity, fatigue strength, wear resistance and heat resistance.

As a production process applicable to mass-produced parts, in which a TiB solid solution is uniformly dispersed, a process is proposed in which a packing density of Ti powder is increased to a prescribed value by controlling the shape of the Ti powder, and miniaturization of residual pores is thus achieved. There is described that according to these procedures, even if Ti powder of low cost is employed, impurities and foreign matters, which should deteriorate the characteristics, are positively used as an agent for improving the characteristics, so as to obtain a sintered Ti alloy material having excellent mechanical properties. According to this process, while the detailed mechanism is not clear, a dense sintered body having a density of 99% can be obtained when 1.8% by weight of B is added, and that having a density of 96% can be obtained even when 3.6% by weight of B is added. Thus, a sintered body having excellent strength, rigidity and fatigue strength can be obtained.

As a process for highly densifying a sintered body, a Ti alloy for powder sintering of high density, in which the amounts of Fe, Mo, Al, V and O are limited and the balance is composed of Ti and unavoidable impurities, is proposed in Japanese Unexamined Patent Publication No. 5-171321. In this process, Fe having a small diffusion rate in a Ti alloy and Mo having a large diffusion rate in a Ti alloy are combined, and sintering is thus conducted within a short period of time at a low temperature to obtain a high density. Because the addition of only Fe is liable to bring about formation of pores in an alloy component due to the Kirkendall effect, Mo having a small diffusion rate is combined to suppress that phenomenon. By further adding suitable amounts of Al and V and controlling the content of O, it provides to develop a sintered Ti alloy having a desired strength.

In Japanese Unexamined Patent Publication No. 5-5142, the excellent strength, rigidity and fatigue strength that have not been obtained by the conventional Ti alloy can be obtained up to the addition amount of B of 1.8% by weight. However, the density of the sintered body is lowered, and along with this, the level of strength is also lowered when B is added in an amount more than 1.8% by weight.

In Japanese Unexamined Patent Publication No. 5-171321, a production process is proposed in which the addition amounts of Fe and Mo are optimized to accelerate the densification at a low temperature within a short period of time, so that a sintered Ti alloy having desired strength is produced at low cost. However, this process still cannot overcome the low rigidity, i.e., the defect of a Ti alloy. Therefore, it cannot be applied to parts requiring rigidity, such as parts for automobiles.

Japanese Examined Patent Publication No. 1-29864 proposes a process in which a hot isostatic pressing is conducted after sintering to densify a sintered Ti alloy. However, a great increase in production cost cannot be avoided on production of mass-produced parts according to this process. Thus, it cannot be applied to inexpensive mass-produced parts, such as parts for automobiles.

As another process for densifying, an activation sintering method utilizing a liquid phase of a low melting point, such as a liquid phase of Ti—Fe, Ti—Ni and Ti—Co, in sintering can be exemplified. However, the process utilizing a liquid phase has a drawback that under the conditions where the densification can be conducted, the phase obtained by solidifying the liquid phase is generally brittle, and sufficient strength characteristics cannot be obtained. Furthermore, there is a case in which a large amount of the liquid phase due to the composition segregation becomes pores as a result of effusion, and a sintered body having a high density cannot be obtained.

As a result of earnest study and various systematic experimentations conducted by the inventors to solve the problems associated with the conventional processes, the present invention has been accomplished.

SUMMARY OF THE INVENTION

An object of the invention is to provide an inexpensive sintered Ti alloy material excellent in strength, rigidity and wear resistance, and a practical process for producing the same.

In order to attain the object, the inventors have not utilized the composition for Ti alloys made by melting, but have conducted selection of the alloy composition that is unique for a sintered Ti alloy material. Accordingly, the interaction energy among the constitutional elements, the diffusion coefficients and the solid solubility to a β-Ti alloy have been considered.

The inventors have thus considered utilizing a liquid phase mainly composed of Ti—Mo—B that is temporarily formed at a temperature slightly lower than the sintering temperature as a sintering acceleration phase. The sintering acceleration phase contains B as a constitutional element. After the sintering, B can form TiB, only the reinforcing particles effective in a Ti alloy, and can improve the strength, rigidity and wear resistance of the resulting sintered Ti alloy material.

Accordingly, the invention has been accomplished by attempting to solve the problems from the approach on a unique standpoint.

The sintered Ti alloy material according to the invention comprises a matrix mainly comprising a Ti alloy, and TiB dispersed and maintained in the matrix, wherein a composition of the sintered Ti alloy material at least comprises from 0.1 to 8.0% by weight of B, from 3.0 to 30.0% by weight of Mo, 50% by weight or more of Ti, and the balance of unavoidable impurities.

DETAILED DESCRIPTION OF THE INVENTION

The sintered Ti alloy material of the invention exhibits excellent strength, rigidity, wear resistance and fatigue characteristics. This is because the sintered Ti alloy of the invention can contain a large amount of a TiB solid solution which improves the strength, rigidity, wear resistance and heat resistance, and even in the case where the TiB solid solution, which is inherently difficult to react with the Ti alloy, is contained in a large amount, it is succeeded to obtain the sintered Ti alloy material having a high density.

While the mechanisms of obtaining the sintered Ti alloy having high density have not been clear, it is considered as follows.

The interaction energy among the constitutional elements of the Ti alloy near the sintering temperature (1,573 K.) is firstly considered. The interaction energy among the elements in the β-Ti alloy at 1,573 K. calculated from the thermodynamics database is −64.8 KJ/mol for Ti—B, 2 KJ/mol for Ti—Mo, and −60.5 KJ/mol for Mo—B. The following can be understood from these values. That is, Ti—B and Mo—B have high affinity with the β-Ti alloy, and the attraction force of Ti—B is the largest. On the other hand, Ti—Mo is repulsion. This indicates that when Mo is present in Ti along with B, Mo is difficult to form a solid solution with Ti.

Figure 1:
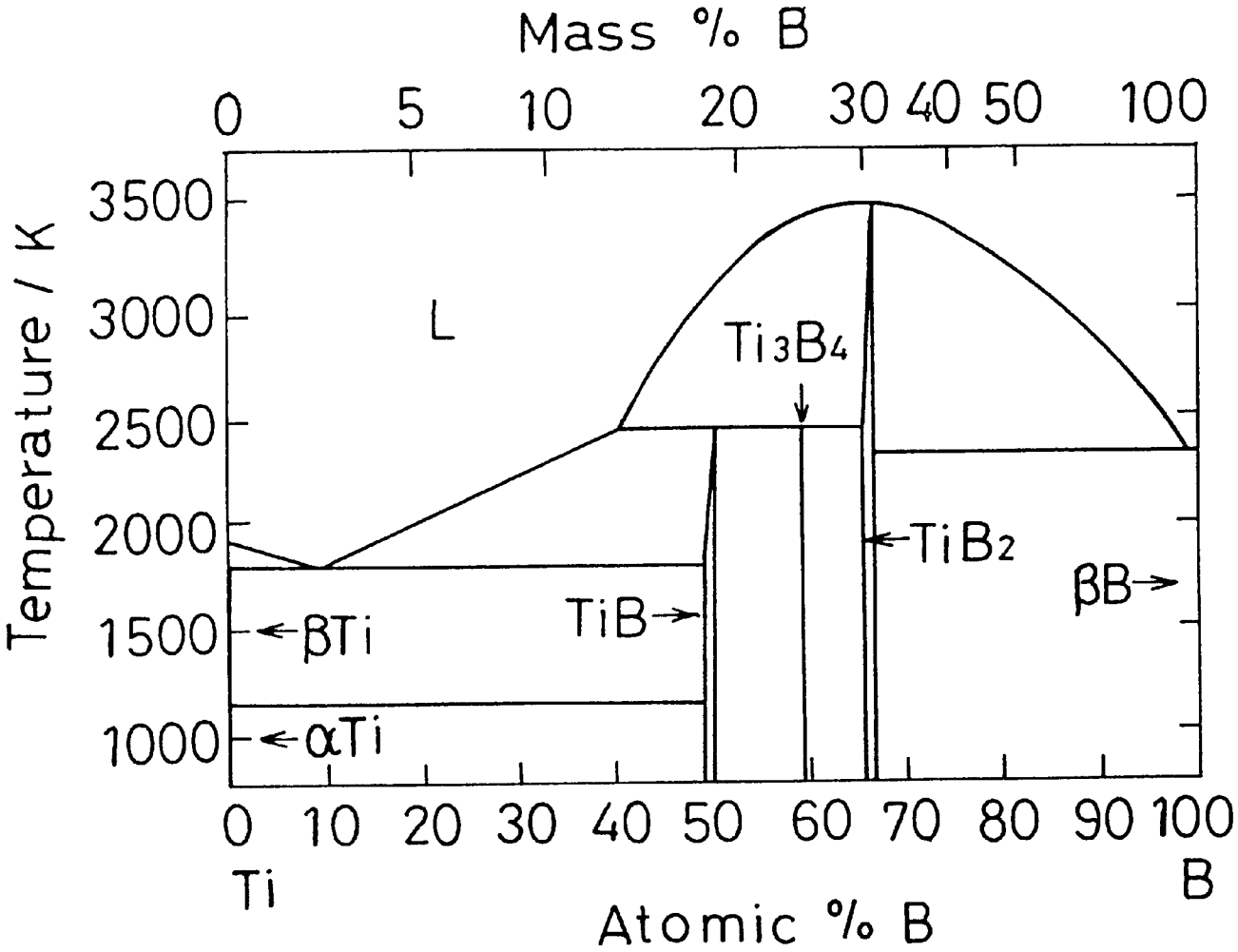
FIG. 1 is a phase diagram of Ti and B.
Figure 2:
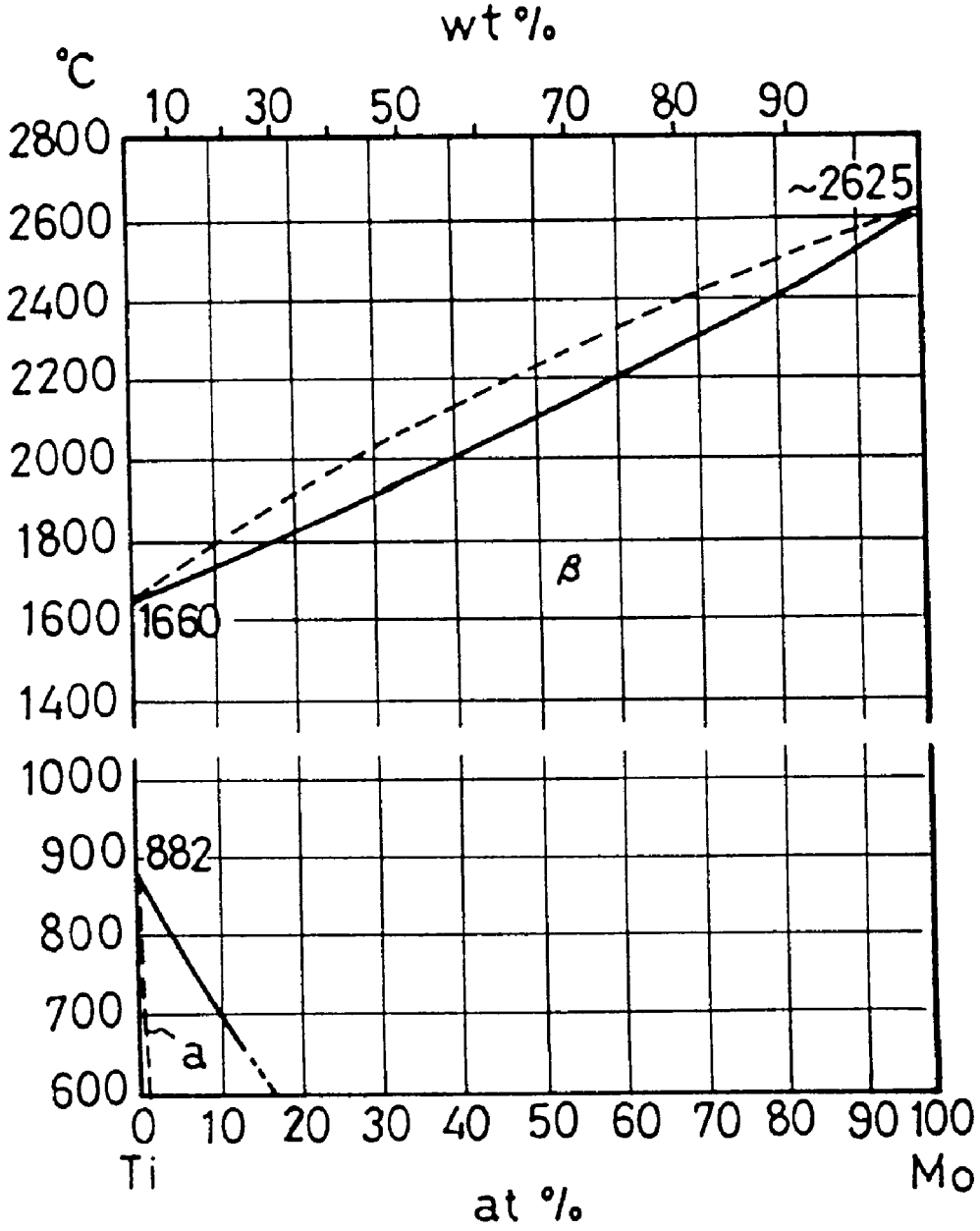
FIG. 2 is a phase diagram of Ti and Mo.

The solid solubility in Ti and the diffusion coefficient in Ti depending on temperature of the each element is secondly considered. FIG. 1 showing the phase diagram of Ti and B and FIG. 2 showing the phase diagram of Mo and Ti are referred. The solid solubilities of B and Mo in Ti are B (ppm)<<Mo. That is, while the solid solubility of B in Ti is in an order of ppm, Ti—Mo forms a solid solution within the whole proportion, and therefore B does not dissolved in β-Ti even at a high temperature of 1,573 K. Although the diffusion coefficient of B is not known as there is no detailed data, it is expected from its extremely small solid solubility that B cannot diffuse in the β-Ti phase to a long distance. The diffusion coefficient of Mo is far smaller than the self-diffusion coefficient of Ti, and is in an order of $10^{-10}$, which is 1/10 of Ti.

While the distribution of the elements at the grain boundaries at a temperature slightly lower than the sintering temperature is considered from the behavior of the elements near the sintering temperature (1,573 K.), B is difficult to be movable in the β-Ti phase, and reacts with Ti at the surface of the Ti powder to form TiB. Mo agglomerates at the grain boundaries due to the interaction with Ti.

Figure 3:
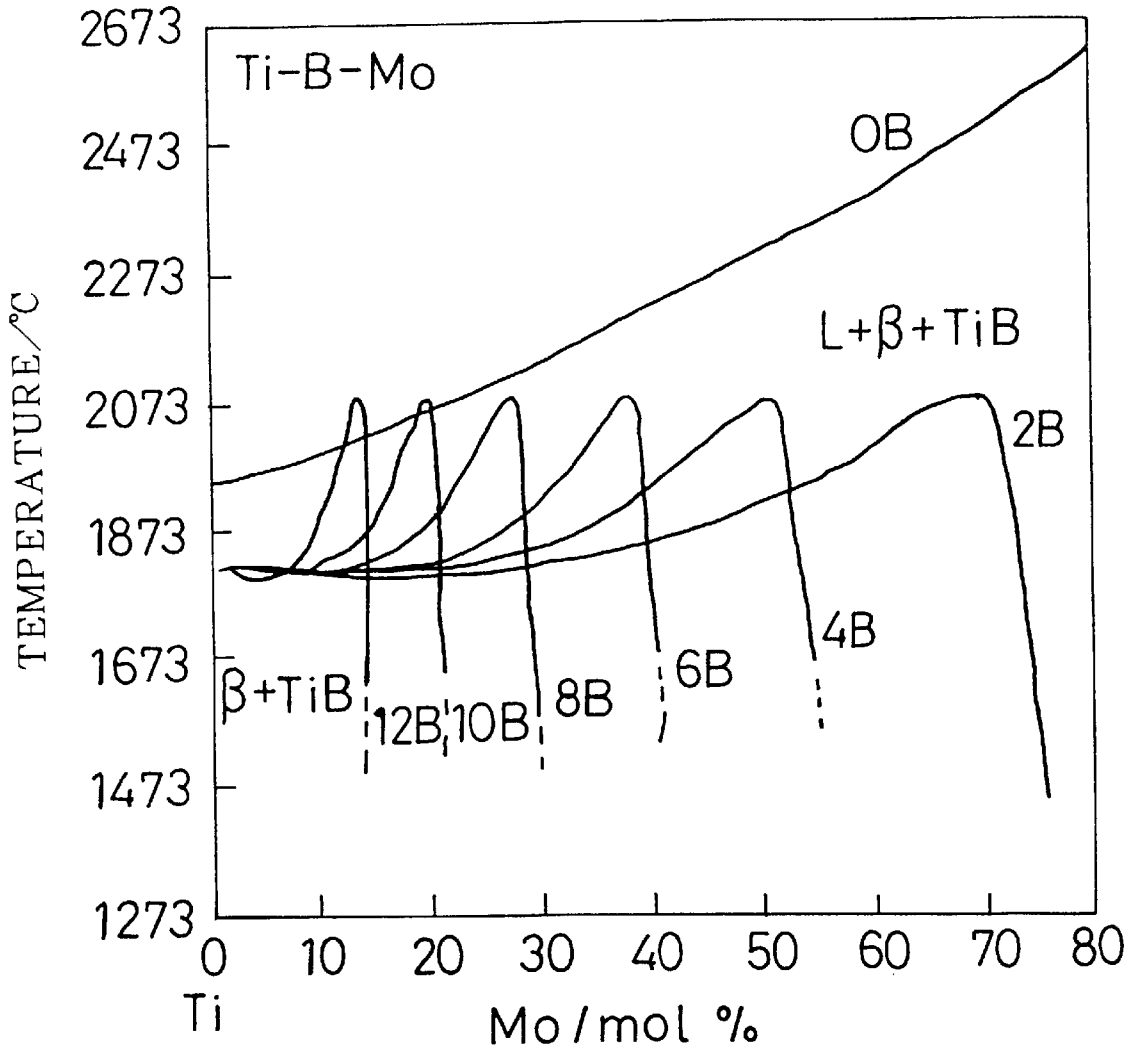
FIG. 3 is a diagram showing the relationship between the B amount and the solidus (solid phase/liquid phase boundary) on the vertical cross section of the pseudo two-component system of Ti—Mo.

FIG. 3 is a diagram showing the relationship between the B amount and the solidus ((β+TiB)/(β+TiB+liquid) phase boundary) on the vertical cross section of the pseudo two-component system of Ti—Mo. The (β+TiB)/(β+TiB+liquid) phase boundary changes depending on the amounts of B and Mo, and the larger the B amount is, the more stable the (β+TiB+liquid) phase is to the low Mo amount. For example, at the (β+TiB)/(β+TiB+liquid) phase boundary of 12B, the (β+TiB)/(β+TiB+liquid) phase boundary can be found at about 15% of Mo at 1,573 K. The (β+TiB)/(β+TiB+liquid) phase boundary can be found in 10B at 1,573 K. at about 20% of Mo. This means that in a system containing B, a localized liquid phase of Ti—Mo—B is generated in a B rich part agglomerated at the grain boundaries at a slightly lower temperature than the sintering temperature.

The localized liquid phase thus-generated gradually disappears along with the diffusion of Mo on sintering, and a brittle phase or pores of effusion are not formed, which are concerned in the general liquid phase sintering. That is, in the Ti—Mo—B series Ti alloy, the temporary liquid phase has a function of accelerating the densification.

The present invention is accomplished based on these findings, and utilizes the interaction of Mo and B with Ti. In other words, the invention is a sintered Ti alloy material characterized in that the densification is conducted by using the temporary Ti—Mo—B liquid phase as a sintering acceleration phase, which is formed by the interaction of Mo and B with Ti at a slightly lower temperature than the sintering temperature.

The content of B constituting the sintered Ti alloy material of the invention is from 0.1 to 8.0% by weight. (All percents hereinafter mean percents by weight unless otherwise indicated.) When the B content is less than 0.1%, the liquid phase sufficient for densification is not supplied the vicinity of the grain boundaries. When the B content exceeds 8.0%, a large amount of TiB particles is deposited to result in insufficient densification and lowered rigidity.

The content of Mo is from 3.0 to 30.0%. When the Mo content is less than 3%, the liquid phase sufficient for densification is not supplied the vicinity of the grain boundaries. When the Mo content exceeds 30.0%, the homogenization of the components on the sintering process becomes insufficient, and sintering at a high temperature for a long period of time is required. Thus, it is not suitable for the production of mass-produced parts. Furthermore, the addition of a large amount of Mo brings about increase in the specific gravity, which lowers the specific strength and the specific rigidity.

In the sintered Ti alloy material of the invention, at least one of Fe, Ni, Co and Cu can be contained. In the sintered Ti alloy material containing at least one of Fe, Ni, Co and Cu, the resulting sintered Ti alloy material is basically densified by utilizing the liquid phase temporarily formed at a slightly lower temperature than the sintering temperature by the interaction of Mo and B with Ti as a sintering acceleration phase.

The addition of Fe, Ni, Co and Cu is to lower the production cost and to improve the productivity. As a result of various investigation about alloy compositions for obtaining a dense sintered Ti alloy material at a low temperature within a short period of time, it is found that it is effective to simultaneously add an element that has the repulsive relationship in the interaction energy with Mo in the Ti alloy, that has a diffusion rate far larger than Mo, and that has a large solid solubility with Ti. It is thus found that the object can be accomplished by adding at least one of Fe, Ni, Co and Cu. The function of the Ti—Fe—Mo—B series material is described in more detail.

The interaction energy between two elements concerning Fe in the β-Ti alloy near the sintering temperature (1,573 K.) is −24.5 KJ/mol for Ti—Fe, 22.4 KJ/mol for Fe—Mo, and −8.8 KJ/mol for Fe—B. Ti—Fe and Fe—B have high affinity with the β-Ti alloy, and Fe-Mo has a relationship of repulsion. This means that in the β-Ti alloy, since the repulsion force between Fe and Mo is large, Fe is stable when present with a Ti atom rather than present with an Mo atom, so that a solid solution of Ti—Fe is liable to be formed. Fe has a diffusion rate as large as 100 times or more than that of Mo.

Accordingly, Fe repulses Mo in the course of temperature increase, and when grain boundaries are formed, Fe is being eliminated from the grain boundaries, so that Fe is bonded to Ti having a negative interaction energy with Ti to form a solid solution. B that is difficult to migrate in the β phase reacts with Ti at the surface of the Ti powder to form TiB. Mo is agglomerated at the grain boundaries due to the interaction with Fe and Ti.

Figure 4:
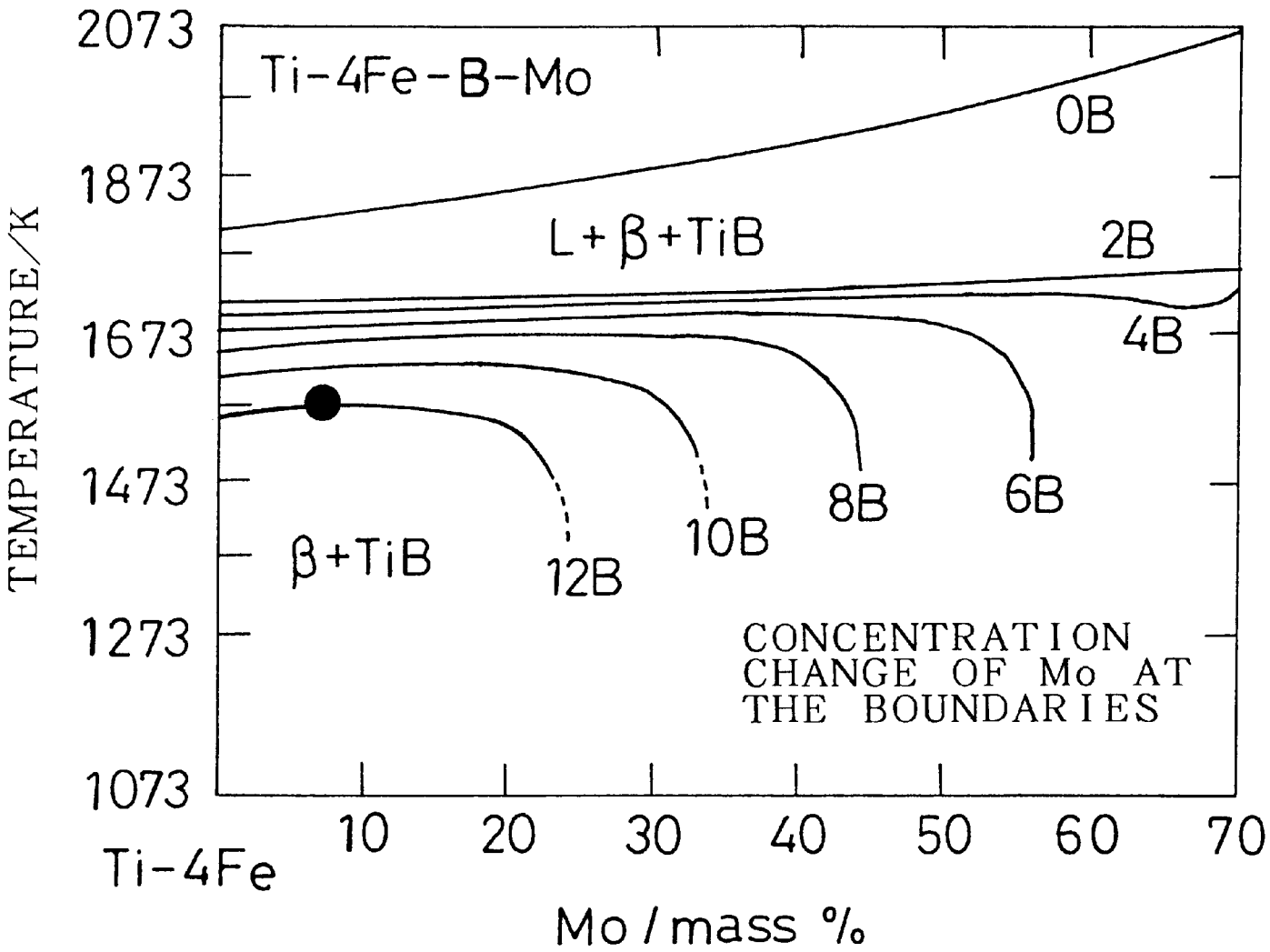
FIG. 4 is a diagram showing the relationship between the B amount and the solid-liquid phase boundary on the vertical cross section of the pseudo two-component system of (Ti-4 Fe)—Mo.

As shown in FIG. 4 of a diagram showing the relationship between the B amount and the solid-liquid phase boundary on the vertical cross section of the pseudo two-component system of (Ti-4 Fe)—Mo, the β-Ti containing Fe, TiB and the Ti—Fe—Mo—B liquid system are equilibrated, and the localized Ti—Fe—Mo—B liquid phase that has a function of densification near the sintering temperature is formed at the grain boundries in the Ti—Fe—Mo—B series Ti alloy material. In this case, since the β-Ti phase containing Fe becomes an equilibrium phase, the β+TiB+liquid phase becomes more stable at a lower temperature than in the sintered Ti alloy material containing no Fe, etc. The localized liquid phase gradually disappears with the diffusion of Mo on sintering. The sintered Ti alloy material containing Fe, etc. has been developed based on these findings.

The content of Fe in the sintered Ti alloy material is preferably from 1.0 to 7.0%. When the content of Fe is less than 1%, the liquid phase sufficient for densification is not supplied to the vicinity of the grain boundaries. When the content of Fe exceeds 7.0%, the rigidity is lowered.

Ni, Co and Cu exhibit the same function as Fe.

The content of Ni is preferably from 1.0 to 7.0%. When the content of Ni is less than 1%, the liquid phase sufficient for densification is not supplied to the vicinity of the grain boundaries. When the content of Ni exceeds 7.0%, a Ti—Ni series intermetallic compound is deposited to lower the rigidity.

The content of Co is preferably from 1.0 to 8.5%. When the content of Co is less than 1%, the liquid phase sufficient for densification is not supplied to the vicinity of the grain boundaries. When the content of Co exceeds 8.5%, a Ti—Co series intermetallic compound is deposited to lower the rigidity.

The content of Cu is preferably from 1.0 to 8.0%. When the content of Cu is less than 1%, the liquid phase sufficient for densification is not supplied to the vicinity of the grain boundaries. When the content of Cu exceeds 7.0%, a Ti—Cu series intermetallic compound is deposited to lower the rigidity.

In the sintered Ti alloy material of the invention, Al may further be contained. Al is an element that strengthens the solid solution of α-Ti, and has a function of highly increasing the Young's modulus as well as the strength. By the addition of Al, the formation of an ω phase, which becomes a factor of embrittlement in the β-Ti alloy. The sintered Ti alloy material containing Al is excellent in both strength and rigidity. The preferred content of Al is from 0.5 to 7.0%. When the content of Al is less than 0.5%, the effect of improvement in strength cannot be obtained. When the content of Al exceeds 7.0%, $Ti_3$ Al is deposited to lower the rigidity. Therefore, the content of Al is preferably from 0.5 to 7.0%.

As the sintered Ti alloy material containing Al, those containing Fe, Ni, Co or Cu are preferred. Specifically, an alloy material can be exemplified that comprises at least one of from 0.1 to 8.0% of B, from 3.0 to 20.0% of Mo, from 1.0 to 7.0% of Fe, from 1.0 to 7.0% of Ni, from 1.0 to 8.5% of Co, and from 1.0 to 8.0% of Cu; from 0.5 to 7.0% of Al; 50% or more of Ti; and the balance of unavoidable impurities.

In the sintered Ti alloy material of the invention, V, Sn, Zr, Nb, Cr and Mn may further be contained. Sn is a neutral type element, which strengthens the solid solution of α-Ti, and has a function of highly increasing the Young's modulus as well as the tensile strength and the fatigue strength. Zr is a neutral type element forming a solid solution within the whole proportion, which strengthens the solid solution, and has a function of highly increasing the Young's modulus as well as the strength, as similar to Sn. V, Nb, Cr and Mn are elements for stabilizing the β-Ti phase. Particularly, they have a function of suppressing the formation of $Ti_3Al$, which becomes a factor of lowering the rigidity, they exhibit an effect of increasing the allowable amount of Al to be contained. They also have an effect increasing the heat treatment characteristics and improving hot workability and warm workability.

The content of Sn is preferably from 1.0 to 5.0%. When the content of Sn is less than 1.0%, the functions of strengthenment and stabilization of the β phase are insufficient. When it exceeds 5.0%, the density becomes large, and $Ti_3Al$ is deposited to lower the rigidity.

The content of Zr is preferably from 1.5 to 6.0%. When the content of Zr is less than 1.5%, the effect of the addition thereof is insufficient. When it exceeds 6.0%, a large amount of a minute intermetallic compound with Ti and Si is deposited to lower the rigidity.

The content of V is preferably from 1.0 to 12.0%. When the content of V is less than 1.0%, the functions of strengthenment and stabilization of the β phase are insufficient. When it exceeds 12.0%, the effect of stabilization of the β phase becomes so strong that the rigidity is lowered.

The content of Nb is preferably from 1.0 to 4.0%. Nb exhibits a function by co-existing with Mo in that the strength characteristics at a high temperature are improved. When the content of Nb is less than 1.0%, the effect of addition thereof is insufficient. When it exceeds 4.0%, the effect of stabilization of the β phase becomes so strong that the ragidity is lowered.

The content of Cr is preferably from 1.0 to 10.0%. When the content of Cr is less than 1.0%, the functions of strengthenment and stabilization of the β phase are insufficient. When it exceeds 10.0%, the effect of stabilization of the β phase becomes so strong that the ragidity is lowered.

The content of Mn is preferably from 1.0 to 6.0%. When the content of Mn is less than 1.0%, the functions of strengthenment and stabilization of the β phase are insufficient. When it exceeds 6.0%, the effect of stabilization of the β phase becomes so strong that the regidity is lowered.

As a more preferred sintered Ti alloy material containing V, Sn, Zr, Nb, Cr and Mn, an alloy material can be exemplified that comprises at least one of from 0.1 to 8.0% of B, from 3.0 to 30.0% of Mo, from 1.0 to 7.0% of Fe, from 1.0 to 7.0% of Ni, from 1.0 to 8.5% of Co, and from 1.0 to 8.0% of Cu; from 0.5 to 7.0% of Al; at least one of from 0.5 to 12.0% of V, from 1.0 to 5.0% of Sn, from 1.5 to 6.0% of Zr, from 1.0 to 4.0% of Nb, from 1.0 to 10.0% of Cr, and from 1.0 to 6.0% of Mn; 50% or more of Ti; and the balance of unavoidable impurities.

The sintered Ti alloy material is one utilizing at least one of Ti—Fe, Ni, Co and Cu, and a liquid phase of Mo—B formed during the sintering as a sintering acceleration phase, which is excellent in both strength and rigidity and also excellent in the balance therebetween.

The process for producing a high density sintered Ti alloy material according to the invention comprises a step of preparing powder for sintering, in which powder for sintering containing 50% or more of Ti powder, and elemental powder or alloy powder of B and Mo containing from 0.1 to 8.0% of B and from 3.0 to 30.0% of Mo, taken the total content as 100%, is prepared; a step of compacting, in which the powder for sintering is compacted to form a green compact; and a step of sintering, in which the green compact is heated to a sintering temperature to form a sintered body.

In the step of preparing the powder for sintering, Ti powder and elemental powder or mother alloy powder containing B, Mo, and at least one of Fe, Ni, Co and Cu are prepared, and these species of the raw material powder are mixed to form mixed powder (powder for sintering). Any known method for mixing powder can be employed in this step, and a uniform mixed powder of the raw material powder can be obtained without any special procedure.

In the step of compacting, the resulting mixed powder for sintering is compacted to a desired shape in a mold to prepare a green compact. The compacting of the mixed powder can be conducted by a known procedure for molding metallic powder under ordinary pressure, and a green compact with a desired shape having strength sufficient to be handled can be easily obtained.

In the step of sintering, the resulting green compact is sintered by heating. The sintering of the green compact can be conducted in vacuo or in a furnace with protective properties at an ordinary temperature for an ordinary time. At a slightly lower temperature than the sintering temperature, a temporary Ti—Mo—B liquid phase, which effectively functions as a sintering acceleration phase, is formed. Accordingly, a sintered body having an intended density can be obtained through this step, to form a bulk material having a desired shape. The production process is one according to the ordinary powder metallurgy technique, and raw material powder that can be easily available and the existing apparatus can be employed. Thus, the sintered Ti alloy material having a high density can be produced at low cost.

In the step of preparing the powder for sintering, the powder for sintering may contain at least one of Mo, Fe, Ni, Co, Cu, Al, V, Sn, Zr, Nb, Cr and Mn. Particularly, upon preparation of powder for sintering containing Fe or Mo, Fe and Mo may be added in the form of an alloy of Fe and Mo, and the constitutional alloy elements may be added in the form of their borides.

In the process for producing a sintered Ti alloy material according to the present invention, any of the elemental powder or alloy powder as raw materials of the powder for sintering does not influence the mechanism of the formation of the temporary liquid phase. Therefore, the species of the starting raw materials are not particularly limited. However, from the standpoint of production cost and productivity of the raw material, it is considered that the use of alloy powder brings about a more practical production process of low cost. Accordingly, it is preferred to add Fe and Mo as an alloy of Fe and Mo, and to add the constitutional alloy elements in the form of their borides.

The Fe—Mo alloy is a material generally used as a material for melting, and is excellent in pulverizing properties, and it does not require any special melting method or pulverizing method. Powder of the various borides is also commercially available, and they do not require any special melting method or pulverizing method. As a result, the desired sintered Ti alloy material can be obtained at low cost without any special procedure.

The sintered Ti alloy material of the present invention comprises a matrix mainly comprising a Ti alloy, and TiB dispersed and maintained in the matrix, wherein a composition of the sintered Ti alloy material at least comprises from 0.1 to 8.0% by weight of B, from 3.0 to 30.0% by weight of Mo, 50% by weight or more of Ti, and the balance of unavoidable impurities. The sintered Ti alloy material has high density and has excellent characteristics, such as high rigidity, high strength and wear resistance. That is, even in the case where a large amount of TiB particles, which are only one material thermodynamically stable in a Ti alloy, are used to form a composite material, a dense sintered body can be obtained by forming the temporary Ti—Mo—B liquid phase effectively functioning as a sintering acceleration phase at a temperature slightly lower than the sintering temperature. As a result, the sintered Ti alloy material of the invention exhibits excellent characteristics, such as high rigidity, high strength and wear resistance.

The sintered Ti alloy material obtained by adding at least one of Fe, Ni, Co and Cu to the sintered Ti alloy material of the invention comprising Ti, B and Mo has a high density and excellent characteristics, such as high rigidity, high strength and wear resistance. That is, even in the case where a large amount of TiB particles, which are only one material thermodynamically stable in a Ti alloy, are used to form a composite material, a dense sintered body can be obtained by forming the temporary Ti—(at least one of Fe, Ni, Co and Cu)—Mo—B liquid phase effectively functioning as a sintering acceleration phase at a temperature slightly lower than the sintering temperature. As a result, the sintered Ti alloy material of the invention exhibits excellent characteristics, such as high rigidity, high strength and wear resistance. Particularly, because at least one of Fe, Ni, Co and Cu is contained, the (β+TiB+liquid) phase becomes stable at a lower temperature, so that a high density sintered Ti alloy material can be obtained in a short period of time.

The sintered Ti alloy material obtained by adding at least one of Fe, Ni, Co and Cu, and Al to the sintered Ti alloy material of the present invention comprising Ti, B and Mo has a high density and excellent characteristics, such as high rigidity, high strength and wear resistance. That is, even in the case where a large amount of TiB particles, which are only one material thermodynamically stable in a Ti alloy, are used to form a composite material, a dense sintered body can be obtained by forming the temporary Ti—(at least one of Fe, Ni, Co and Cu)—Mo—B liquid phase effectively functioning as a sintering acceleration phase at a slightly lower temperature than the sintering temperature. As a result, the sintered Ti alloy material of the invention exhibits excellent characteristics, such as high rigidity, high strength and wear resistance. Furthermore, by the addition of Al, a high density sintered Ti alloy material having an excellent balance between strength and rigidity can be obtained.

The sintered Ti alloy material obtained by further adding at least one of Sn, Zr, V, Nb, Cr and Mn is a sintered Ti alloy material having a high density and excellent characteristics, such as high rigidity, high strength and wear resistance. Because at least one of Sn, Zr, V, Nb, Cr and Mn is contained, the formation of $Ti_3$ Al and an ω phase, which become a factor of lowering of rigidity, can be suppressed. Thus, a high density sintered Ti alloy material having an excellent balance between strength and rigidity can be obtained. Furthermore, its hot workability and warm workability can be improved.

By using an Fe-Mo alloy and borides as raw material powder, the desired sintered Ti alloy material can be obtained at low cost.

A Ti alloy has been used as high strength parts in the fields of aircraft, space developments and military apparatuses, owing to its lightweight and high strength. However, there is no example that the Ti alloy is applied to mass-produced parts, to which steel has been frequently applied, because the cost is extremely high. Furthermore, the Ti alloy has a low rigidity (about half) in comparison to steel, and is inferior in wear resistance. Thus, it has not been able to satisfy the needs of automobile parts designers from the standpoint of not only cost but also characteristics.

The sintered Ti alloy material of the present invention satisfies such needs. Therefore, the sintered Ti alloy material of the invention can be applied to the field, to which such needs are applied. For example, it can be applied to automobile engine parts, various sporting utensils and tools.

Specific examples of applications in automobile engine parts include a valve retainer, a valve lifter and a connecting rod. Representative examples of the sporting utensils include a golf club head, an iron head and a putter.

The valve retainer, the valve lifter and the connecting rod are required to have not only mass-productivity on the production process of automobile parts but also excellent cold workability, warm workability and hot workability. Furthermore, in order to satisfy their function, they are required to have high strength, particularly high fatigue strength. Accordingly, it is preferred to use a sintered Ti alloy material comprising from 0.18 to 5.4% of B; from 3.0 to 30.0% of Mo; at least one of from 1.0 to 7.0% of Fe, from 1.0 to 7.0% of Ni, from 1.0 to 8.5% of Co and from 1.0 to 8.0% of Cu; from 0.5 to 7.0% of Al; at least one of from 0.5 to 12.0% of V, from 1.0 to 5.0% of Sn, from 1.5 to 6.0% of Zr, from 1.0 to 4.0% of Nb, from 1.0 to 10.0% of Cr and from 1.0 to 6.0% of Mn; 50% or more of Ti; and the balance of unavoidable impurities.

The golf club head, the iron head and the putter are required to have excellent hot workability on their production process. Accordingly, it is preferred to use a sintered Ti alloy material comprising from 0.1 to 8.0% of B; from 3.0 to 20.0% of Mo; at least one of from 1.0 to 7.0% of Fe, from 1.0 to 7.0% of Ni, from 1.0 to 8.5% of Co and from 1.0 to 8.0% of Cu; from 0.5 to 7.0% of Al; at least one of from 0.5 to 12.0% of V, from 1.0 to 5.0% of Sn, from 1.5 to 6.0% of Zr, from 1.0 to 4.0% of Nb, from 1.0 to 10.0% of Cr and from 1.0 to 6.0% of Mn; 50% or more of Ti; and the balance of unavoidable impurities.

It has been a well-known concept that high strength and high rigidity are obtained by making a composite material. However, in the case of a metallic composite material, particularly a Ti alloy composite material, since Ti as a matrix is an active metal, the reinforcing phase reacts with the matrix to form a brittle reaction phase at the boundaries therebetween, and cracks are formed in the brittle phase due to the difference in thermal expansion between the reinforcing phase and the Ti matrix. Because of such a reason, only a material has been obtained that exhibits performance greatly lower than the theoretical value calculated from the ideal theory of composite materials.

On the other hand, the present inventors have demonstrated that the TiB particles are only one effective species, and characteristics that substantially agree with the theory of composite materials can be obtained within the range where a dense sintered body can be obtained. Furthermore, according to the invention, in which the interaction with the Ti alloy is considered, a high density sintered Ti alloy material that can provide a dense sintered body can be obtained even when 44% by volume of the TiB particles are used to form a composite material.

In the present invention, the Ti—Mo—B liquid phase as the sintering acceleration phase is formed during the sintering by adding at least B and Mo. There has been no report that a temporary liquid phase is formed by interaction energy or physical phenomena such as diffusion and solid solubility, to achieve densification. In the sintered Ti alloy material of the present invention, as an alloy composition to obtain the sintered Ti alloy material at a low temperature in a short period of time for lowering the production cost and improving the productivity, a sintered Ti alloy material is preferred that contains at least one of Fe, Ni, Co and Cu, as well as B and Mo. Furthermore, by adding elemental powder or mother alloy powder containing at least one of V, Sn, Zr, Nb, Cr and Mn to the sintered Ti alloy material comprising at least one of Fe, Ni, Co and Cu, as well as B and Mo, a high density sintered Ti alloy material having an excellent balance between strength and rigidity can be obtained.

The process for producing the sintered Ti alloy material is described in detail as follows. The process comprises a step of preparing powder for sintering, a step of compacting, and a step of sintering. In the step of preparing powder for sintering, Ti powder and elemental powder or mother alloy powder of B and Mo are mixed to form the powder for sintering. In the case where the productivity is considered, elemental powder or mother alloy powder containing at least one of Fe, Ni, Co and Cu is further mixed, and in the case where excellent balance between strength and rigidity, elemental powder or mother alloy powder containing at least one of V, Sn, Nb, Cr and Mn is further mixed. In the step of compacting, the resulting mixed powder for sintering is molded into a desired shape to form a green compact. In the step of sintering, the resulting green compact is sintered by heating. By using the powder for sintering, a high density sintered Ti alloy material can be produced at low cost by utilizing the temporary liquid phase of Ti—Mo—B or Ti—(at least one of Fe, Ni, Co and Cu)—Mo—B that effectively functions as a sintering acceleration phase at a slightly lower temperature than the sintering temperature.

As the Ti powder used in the step of preparing the powder for sintering, any commercially available Ti powder can be used. For example, sponge titanium powder, hydride-dehydride titanium powder, hydrogenated titanium powder and atomized titanium powder may be used as they are. The particle size of the commercially available powder is often controlled to about 150 μm (−#100) or less. Ti powder having a particle size of 45 μm (−#325) or less is preferred since the densification of the sintered body can be easily realized.

As elemental powder or mother alloy powder containing at least one of Fe, Ni, Co and Cu; at least one of V, Sn, Zr, Nb, Cr and Mn; B and Mo, any of commercially available products or those produced by known processes can be used. Particularly, in the case where the sintered Ti alloy material utilizing the Ti—Fe—Mo—B phase as the sintering acceleration phase is produced at low cost, it is preferred that Fe and Mo are added in the form of an alloy of Fe and Mo, or the constitutional elements are added in the form of borides. It is preferred to use the alloy powder and the boride powder having a particle size of several $\mu$m, and when they are larger than such a size, it is preferred that they are pulverized to control the particle size by various pulverizing apparatuses such as a ball mill, a vibration mill and an attritor.

The method of mixing using the step of preparing the powder for sintering is not particularly limited, and a V-type mixer, a ball mill and a vibration mill can be used. In the case where the boride powder is extremely liable to be coagulated to form secondary particles, it is effective to activate densification that the powder is stirred and mixed by a high energy ball mill, such as an attritor, in an inert gas atmosphere.

The method of compacting may be any method by which a desired shape can be obtained, and molding with a metallic mold, a cold isostatic pressing and a rubber isostatic pressing can be employed. The compacting pressure is not particularly limited if the sufficient strength of the green compact to be handled is obtained.

In the step of sintering, the atmosphere is preferably a vacuum or an inert gas atmosphere. It is preferred to conduct sintering at a temperature range of from 1,200 to 1,300° C. for from 1 to 16 hours. By the sintering at a temperature lower than 1,200° C. for less than 1 hour, the liquid phase sufficient for densification is not supplied to the vicinity of the grain boundaries. The sintering at a temperature more than 1,300° C. for more than 16 hours is not economical from the standpoint of energy.

A hot working step is preferably conducted after the step of sintering. As the hot working method, a hot isostatic pressing, hot forging, extruding and swaging can be employed. The working temperature is preferably from 700 to 1,200° C. When it is lower than 700° C., the deformation resistance is too large, and when it is higher than 1,200° C., the oxidation becomes severe. In both cases, it is not preferred since the characteristics of the material may be adversely affected, and minute cracks may be formed on the surface during the hot working.

The invention is described in more detail by referring to the following examples.

EXAMPLE 1

As raw material powder, commercially available hydride-dehydride Ti powder (−#325), Mo powder (average particle size: 3 $\mu$m) and $TiB_2$ powder (average particle size: 2 $\mu$m) were prepared. The hydride-dehydride Ti powder, the Mo powder and the $TiB_2$ powder were mixed at the proportion shown in Table 1 below to form powder for sintering. The mixed powder for sintering was carried out a cold isostatic pressing at a pressure of 4 ton/mm$^2$ to form a green compact having a shape of 20 mm in diameter×100 mm. The green compact was sintered in vacuum of $1\times10^{-5}$ torr at 1,300° C. for 8 hours. Hot working was further conducted by using a hot swaging apparatus at a temperature of 1,100° C. with dices until 12 mm in diameter. The resulting sintered body was designated Sample No. 1.

TABLE 1

| Sample No. | Alloy composition | Relative density after sintering (%) | Processing after sintering | Tensile strength (MPa) | Elongation (%) | Young's modulus (GPa) | Remarks |
|---|---|---|---|---|---|---|---|
| 1 | Ti-10 Mo-3.5 B | 99.0 | Hot swaging | 1,525 | 2.0 | 157 | *1 |
| 2 | Ti-5.0 Fe-8.0 Mo-1.8 B | 99.5 | Hot swaging | 1,380 | 3.8 | 132 | *1 |
| 3 | Ti-4.3 Fe-7.0 Mo-1.4 Al-1.4 V-5.4 B | 98.5 | Hot swaging | 2,025 | 1.4 | 180 | *1 |
| 4 | Ti-5.0 Mo-1.4 Al-1.4 V-3.5 B | 99.2 | Hot swaging | 1,630 | 4.3 | 160 | *1 |
| 5 | Ti-6 Al-4 V-1.2 Fe-2.0 Mo-3.6 B | 98.5 | Hot extruding | 1,911 | 1.5 | 162 | *1 |
| 6 | Ti-4.3 Fe-8.5 Mo-1.5 Al-3.6 B | 98.9 | Hot swaging | 1,740 | 1.8 | 152 | *1 |
| 7 | Ti-4.0 Ni-6.0 Mo-1.4 Al-1.4 V-3.5 B | 98.8 | Hot swaging | 1,645 | 1.0 | 155 | *1 |
| 8 | Ti-2.0 Co-2.0 Mo-1.4 Al-1.4 V-1.8 B | 99.3 | Hot swaging | 1,350 | 5.2 | 130 | *1 |
| 9 | Ti-3.0 Cu-4.0 Mo-2.1 B | 99.0 | Hot swaging | 1,555 | 2.5 | 156 | *1 |
| 10 | Ti-4.3 Fe-9.0 Mo-1.8 B | 99.0 | Hot swaging | 1,585 | 3.1 | 145 | *1 |
| C1 | Ti-6 Al-4 V-5.4 B | 92.0 | HIP treatment | 1,200 | 0.8 | 138 | *2 |
| C2 | Ti-4.3 Fe-7.0 Mo-1.4 Al-1.4 V-8.1 B | 95.5 | Hot swaging | — | — | — | *3 |
| C3 | Ti-4.3 Fe-7.0 Mo-1.4 Al-1.4 V-3.0 C | 96.0 | Hot extruding | — | — | — | *3 |
| C4 | Ti-4.3 Fe-7.0 Mo-1.4 Al-1.4 V | 99.0 | Hot swaging | 1,100 | 15.0 | 108 | *4 |
| C5 | Ti-3 Al-2 V-7 Fe-3.8 B | 95.5 | HIP treatment | 1,150 | 0.5 | 128 | *2 |
| C6 | Ti-4.3 Fe-32.0 Mo-1.4 Al-1.4 V-3.8 B | 99.0 | Hot swaging | 1,510 | 0.3 | 152 | *5 |

Note:
Sample Nos. 1 to 10 are examples of the invention.
Sample Nos. C1 to C6 are comparative examples.
Remarks:
*1: Possible to be worked
*2: Not densified
*3: Impossible to be worked
*4: Insufficient strength
*5: Insufficient rigidity

EXAMPLE 2

As raw material powder, commercially available hydride-dehydride Ti powder (−#325), Fe-68 Mo powder (average particle size: 9 $\mu$m) and $TiB_2$ powder (average particle size: 2 $\mu$m) were prepared. The hydride-dehydride Ti powder, the Fe-68 Mo powder and the $TiB_2$ powder were mixed at the proportion shown in Table 1 to form the mixed powder for sintering. The mixed powder for sintering was carried out a cold isostatic pressing and sintering under the same conditions as in Example 1. Hot working was further conducted under the same conditions as in Example 1. The resulting sintered body was designated Sample No. 2.

EXAMPLE 3

As raw material powder, commercially available hydride-dehydride Ti powder (−#325), Fe-68 Mo powder (average particle size: 9 μm), Al-50 V powder (average particle size: 9 μm), Al-40 V powder (average particle size: 9 μm) and $TiB_2$ powder (average particle size: 2 μm) were prepared. All the species of the powder were mixed at the proportions shown in Table 1 to form the mixed powder for sintering. The two kinds of the mixed powder for sintering were carried out a cold isostatic pressing and sintering under the same conditions as in Example 1. Hot working was further conducted under the same conditions as in Example 1. The resulting sintered bodies were designated Sample Nos. 3 and 4.

Figure 5:
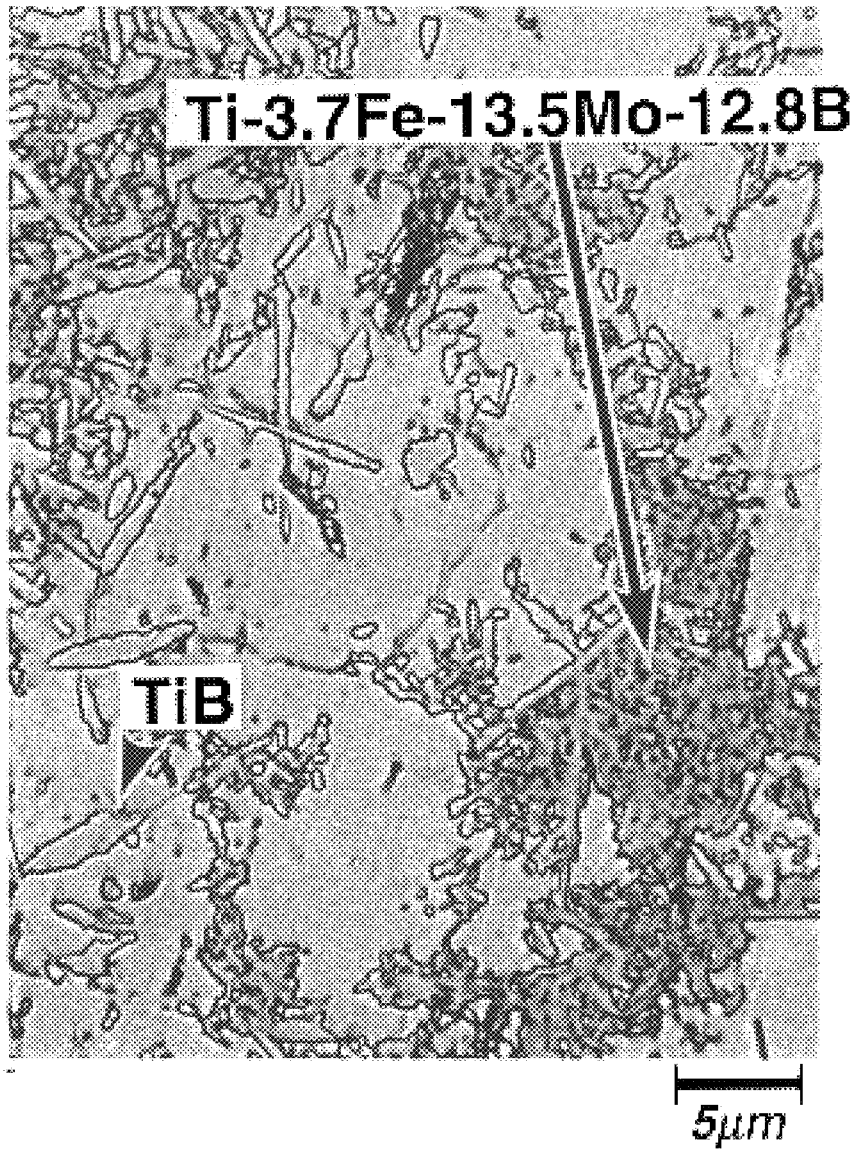
FIG. 5 is a photomicrograph showing the microstructure of the frozen liquid phase formed at a temperature slightly lower that the sintering temperature in Sample No. 3 in Example 3.

FIG. 5 is a photomicrograph showing the microstructure of the frozen liquid phase formed at a slightly lower temperature than the sintering temperature of Sample No. 3. The frozen microstructure was subjected to local analysis by EPMA. As a result, it was found that the frozen liquid phase was composed of Ti—Fe—Mo—B, which was the frozen tissue of the liquid phase that was expected from the phase diagram.

Figure 6:
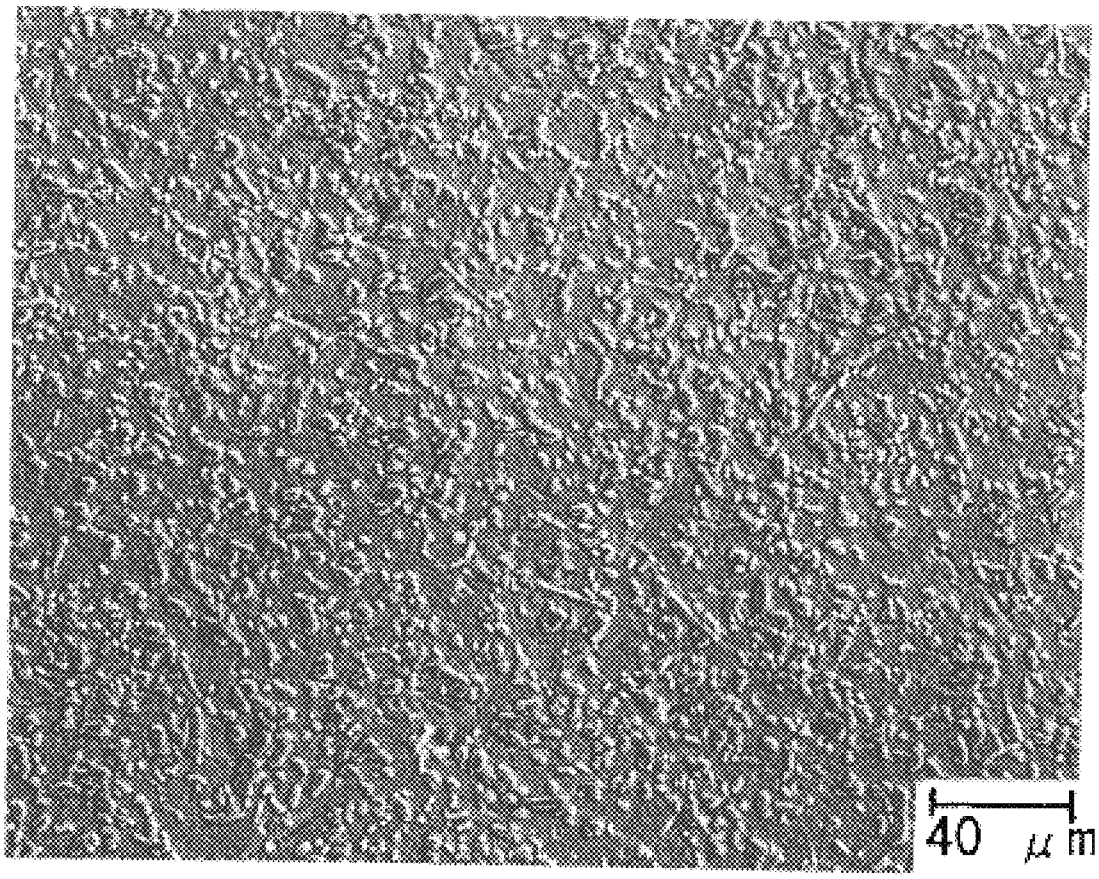
FIG. 6 is a photomicrograph showing the microstructure of the material after hot working of Sample No. 3 in Example 3.

FIG. 6 is a photomicrograph showing the microstructure of the material after hot working of Sample No. 3. As apparent from the figure, the microstructure comprised a matrix of a β-Ti phase and a minute α-Ti phase deposited therein, and TiB particles uniformly dispersed in the matrix to form a composite structure.

EXAMPLE 4

As raw material powder, commercially available hydride-dehydride Ti powder (−#325), Mo powder (average particle size: 3 μm), Al-50 V powder (average particle size: 9 μm) and $TiB_2$ powder (average particle size: 2 μm) were prepared. All the species of the powder were mixed at the proportion shown in Table 1 to form the mixed powder for sintering. The mixed powder for sintering was carried out a cold isostatic pressing and sintering under the same conditions as in Example 1. Hot working was further conducted by using a hot extruding apparatus at a temperature of 1,100° C. to a diameter of 6 mm. The resulting sintered body was designated Sample No. 5.

EXAMPLE 5

As raw material powder, commercially available hydride-dehydride Ti powder (−#325), Fe-68 Mo powder (average particle size: 9 μm), Al-50 Mo powder (average particle size: 9 μm) and $TiB_2$ powder (average particle size: 2 μm) were prepared. All the species of the powder were mixed at the proportion shown in Table 1 to form the mixed powder for sintering. The powder for sintering was carried out a cold isostatic pressing and sintering under the same conditions as in Example 1. Hot working was further conducted under the same conditions as in Example 1. The resulting sintered body was designated Sample No. 6.

EXAMPLE 6

As raw material powder, commercially available hydride-dehydride Ti powder (−#325), Mo powder (average particle size: 3 μm), Co powder (average particle diameter: 3 μm), Ni powder (average particle diameter: 3 μm), Al-50 V powder (average particle size: 9 μm) and $TiB_2$ powder (average particle size: 2 μm) were prepared. All the species of the powder were mixed at the proportions shown in Table 1 to form the mixed powder for sintering. The two kinds of the mixed powder for sintering were carried out a cold isostatic pressing and sintering under the same conditions as in Example 1. Hot working was further conducted under the same conditions as in Example 1. The resulting sintered bodies were designated Sample Nos. 7 and 8.

EXAMPLE 7

As raw material powder, commercially available hydride-dehydride Ti powder (−#325), Mo powder (average particle size: 3 μm), Cu powder (average particle size: 3 μm) and $TiB_2$ powder (average particle size: 2 μm) were prepared. All the species of the powder were mixed at the proportion shown in Table 1 to form the mixed powder for sintering. The mixed powder for sintering was carried out a cold isostatic pressing and sintering under the same conditions as in Example 1. Hot working was further conducted under the same conditions as in Example 1. The resulting sintered body was designated Sample No. 9.

EXAMPLE 8

As raw material powder, commercially available hydride-dehydride Ti powder (−#325), FeB powder (average particle size: 3 μm) and MoB powder (average particle size: 2 μm) were prepared. All the species of the powder were mixed at the proportion shown in Table 1 to form the mixed powder for sintering. The mixed powder for sintering was carried out a cold isostatic pressing and sintering under the same conditions as in Example 1. Hot working was further conducted under the same conditions as in Example 1. The resulting sintered body was designated Sample No. 10.

EXAMPLE 9

As raw material powder, commercially available hydride-dehydride Ti powder (−#325), Fe-68 Mo powder (average particle diameter: 9 μm), Al-50 V powder (average particle diameter: 9 μm), Mo powder (average particle size: 9 μm) and $TiB_2$ powder (average particle size: 2 μm) were prepared. The hydride-dehydride Ti powder, the Fe-68 Mo powder, the Al-50 V powder, the Al-40 V powder, the Mo powder and the $TiB_2$ powder were mixed at the proportions for Sample Nos. 11 and 12 shown in Table 2 to form the mixed powder for sintering. The two kinds of the mixed powder for sintering were carried out a cold isostatic pressing at a pressure of 4 ton/mm$^2$ to form green compacts having a shape of 20 mm in diameter×100 mm. The green compacts were sintered in a vacuum of $1\times10^{-5}$ torr at 1,300° C. for 4 hours. The resulting sintered bodies were designated Sample Nos. 11 and 12.

TABLE 2

| Sample No. | Example/ Comparative Example | Alloy Composition | Sintering conditions | Relative density (%) |
|---|---|---|---|---|
| 11 | Example 9/Claim 1 | Ti-7.0 Mo-1.4 Al-1.4 V-1.8 B | 1,300° C. × 4 hours | 96.5 |
| 12 | Example 9/Claim 2 | Ti-4.3 Fe-7.0 Mo-1.4 Al-1.4 V-1.8 B | 1,300° C. × 4 hours | 99.2 |
| C7 | Comparative Example 5 | Ti-6 Al-4 V-1.8 B | 1,300° C. × 4 hours | 92.0 |

COMPARATIVE EXAMPLE 1

As raw material powder, commercially available hydride-dehydride Ti powder (–#325), Al-40 V powder (average particle size: 9 μm) and $TiB_2$ powder (average particle size: 2 μm) were prepared. All the species of the powder were mixed at the proportion for Sample No. C1 shown in Table 1 to form the mixed powder for sintering. The powder for sintering was carried out a cold isostatic pressing at a pressure of 4 ton/mm$^2$ to form a green compact having a shape of 20 mm in diameter×100 mm. The green compact was sintered in a vacuum of $1\times10^{-5}$ torr at 1,300° C. for 8 hours. Densification was tried to be conducted by using a hot isostatic pressing at a temperature of 930° C. for 3 hours. The resulting sintered body was designated Sample No. C1.

Figure 7:
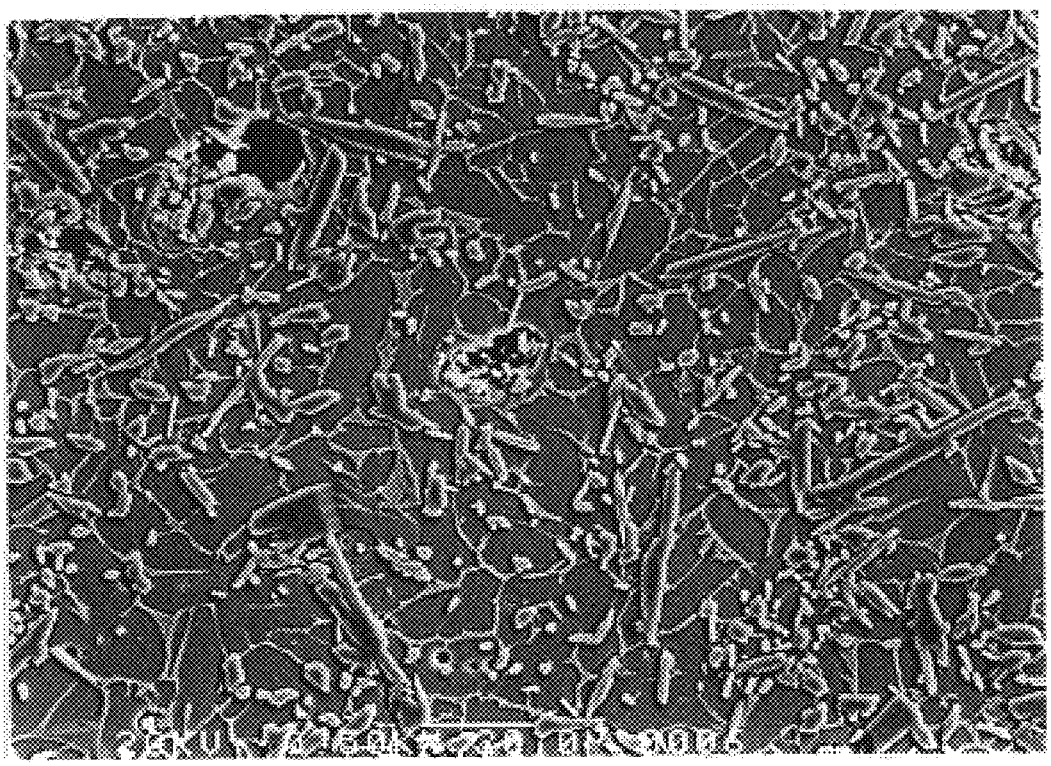
FIG. 7 is a photomicrograph showing the microstructure of the material after the hot isostatic pressing of Sample No. C1 in Comparative Example 1.

FIG. 7 is a photomicrograph showing the microstructure of the tissue of the material after the hot isostatic pressing. As apparent from the figure, the tissue comprised a matrix of an α+β phase and α-Ti particles dispersed therein to form a composite structure. Densification did not sufficiently proceed, and pores remained after the hot isostatic pressing.

COMPARATIVE EXAMPLE 2

As raw material powder, commercially available hydride-dehydride Ti powder (–#325), Fe-68 Mo powder (average particle diameter: 9 μm), Al-50 V powder (average particle diameter: 9 μm), Al-40 V powder (average particle size: 9 μm), $TiB_2$ powder (average particle size: 2 μm) and TiC powder (average particle diameter: 3 μm) were prepared. All the species of the powder were mixed at the proportions for Sample Nos. C2, C3 and C4 shown in Table 1 to form the mixed powder for sintering. The three kinds of the mixed powder for sintering were carried out a cold isostatic pressing at a pressure of 4 ton/mm$^2$ to form green compacts having a shape of 20 mm in diameter×100 mm. The green compact were sintered in a vacuum of $1\times10^{-5}$ torr at 1,300° C. for 8 hours. Hot working was further conducted by using a hot swaging apparatus at a temperature of 1,100° C. with dices having the size of until 12 mm in diameter. The resulting sintered bodies were designated Sample Nos. C2, C3 and C4.

COMPARATIVE EXAMPLE 3

As raw material powder, commercially available hydride-dehydride Ti powder (–#325), Al-40 V powder (average particle size: 9 μm), Fe powder (average particle diameter: 3 μm) and $TiB_2$ powder (average particle size: 2 μm) were prepared. All the species of the powder were mixed at the proportion for Sample No. C5 shown in Table 1 to form the mixed powder for sintering. The mixed powder for sintering was carried out a cold isostatic pressing at a pressure of 4 ton/mm$^2$ to form green compacts having a shape of 20 mm in diameter×100 mm. The green compact was sintered in vacuum of $1\times10^{-5}$ torr at 1,300° C. for 8 hours. Hot working was further conducted by using a hot swaging apparatus at a temperature of 1,100° C. with dices having the size of until 12 mm in diameter. The resulting sintered body was designated Sample No. C5.

COMPARATIVE EXAMPLE 4

As raw material powder, commercially available hydride-dehydride Ti powder (–#325), Fe-Mo powder (average particle size: 3 μm), Fe powder (average particle diameter: 3 μm) and $TiB_2$ powder (average particle size: 2 μm) were prepared. All the species of the powder were mixed at the proportion for Sample No. C6 shown in Table 1 to form the mixed powder for sintering. The mixed powder for sintering was carried out a cold isostatic pressing at a pressure of 4 ton/mm$^2$ to form green compacts having a shape of 20 mm in diameter×100 mm. The green compact was sintered in a vacuum of $1\times10^{-5}$ torr at 1,300° C. for 8 hours. Hot working was further conducted by using a hot swaging apparatus at a temperature of 1,100° C. with dices having the size of until 12 mm in diameter. The resulting sintered body was designated Sample No. C6.

The samples obtained in Examples 1 to 8 and Comparative Examples 1 to 4 were measured for density after sintering by the method of Archimedes. The resulting density values are shown in Table 1. The samples after hot working were subjected to a heat treatment at 650° C. for 1 hour A.C., and measured for tensile strength, elongation and Young's modulus. The resulting values of tensile strength, elongation and Young's modulus are shown in Table 1.

As apparent from the results shown in Table 1, the Ti alloy materials according to the invention had a high density of 98.5% or more, high tensile strength of 1,350 MPa or more, and high Young's modulus of 130 GPa or more. It was found that by optimizing the composition, tensile strength of 2,000 MPa and a Young's modulus of 180 GPa could be obtained.

It was also found that the sintered Ti alloy materials of the examples according to the invention could be subjected to hot swaging and hot extruding, and they had excellent workability.

On the other hand, the sintered Ti alloy materials having compositions outside the scope of the invention were poor in hot ductility due to insufficient densification and difficult to produce a desired rod material, or even if hot working could be conducted, they had considerably low strength and rigidity.

COMPARATIVE EXAMPLE 5

As raw material powder, commercially available hydride-dehydride Ti powder (–#325), Al-40 V powder (average particle size: 9 μm) and $TiB_2$ powder (average particle size: 2 μm) were prepared. The hydride-dehydride Ti powder, the Al-40 V powder and $TiB_2$ powder were mixed at the proportion for Sample No. C7 shown in Table 2 to form two kinds of the mixed powder for sintering. The two kinds of the mixed powder for sintering were carried out a cold isostatic pressing at a pressure of 4 ton/mm$^2$ to form green compacts having a shape of 20 mm in diameter×100 mm. The green compact was sintered in a vacuum of $1\times10^{-5}$ torr at 1,300° C. for 4 hours. The resulting sintered body was designated Sample No. C7.

Tables 2 and 3 show Example 9 for demonstrating further progressiveness and applicability of the present invention, and Comparative Example 5 outside the scope of the present invention. It is preferred that a desired sintered relative density can be obtained in a short period of time from the standpoint of practical applicability. The comparison of the sintered bodies was thus conducted by employing the sintering time of 4 hours. It was found that a dense sintered body could be obtained according to the present invention. The sample of Comparative Example 5 outside the scope of the present invention only exhibited a relative density of 92%.

TABLE 3

| Sample No. | Example/ Comparative Example | Alloy Composition | Sintering conditions | Relative density (%) | Strength (MPa) | Elongation (%) |
|---|---|---|---|---|---|---|
| 11 | Example 9 /Claim 1 | Ti-7.0 Mo-1.4 Al-1.4 V-1.8 B | 1,300° C. × 4 hours | 96.5 | 1,265 | 1.2 |
| 12 | Example 9 /Claim 2 | Ti-4.3 Fe-7.0 Mo-1.4 Al-1.4 V-1.8 B | 1,300° C. × 4 hours | 99.2 | 1,450 | 2.0 |
| C7 | Comparative Example 5 | Ti-6 Al-4 V-1.8 B | 1,300° C. × 4 hours | 92.0 | 1,050 | — |

It is understood from the results of the Examples and Comparative Examples that a highly practical high density sintered Ti alloy material can be obtained by adding, an element along with Mo, that has a repulsive relationship against Mo with respect to interaction energy in a Ti alloy, and has an extremely larger diffusion rate than Mo and a large liquid solubility in Ti.

What is claimed is:

1. A sintered Ti alloy material comprising a Ti alloy as a matrix, and TiB dispersed in said matrix, wherein said sintered Ti alloy material comprises from 0.1 to 8.0% by weight of B, from 2.0 to 30.0% by weight of Mo, 50% by weight or more of Ti, at least one selected from the group consisting of Fe, Ni, Co and Cu, and a balance of unavoidable impurities.

2. A sintered Ti alloy material comprising a Ti alloy as a matrix, and TiB dispersed in said matrix, wherein said sintered Ti alloy material comprises from 0.1 to 8.0% by weight of B, from 2.0 to 30.0% by weight of Mo, 50% by weight or more of Ti, at least one selected from the group consisting of Fe in an amount of from 1.0 to 7.0% by weight, Ni in an amount of from 1.0 to 7.0% by weight, Co in an amount of from 1.0 to 8.5% by weight, and Cu in an amount of from 1.0 to 8.0% by weight, and a balance of unavoidable impurities.

3. A sintered Ti alloy material as claimed in claim 1, wherein said sintered Ti alloy material further comprises Al.

4. A sintered Ti alloy material as claimed in claim 3, wherein Al is contained in an amount of from 0.5 to 6.5% by weight.

5. A sintered Ti alloy material as claimed in claim 1, wherein said sintered Ti alloy material further comprises at least one selected from the group consisting of V, Sn, Zr, Nb, Cr and Mn.

6. A sintered Ti alloy material as claimed in claim 5, wherein V is contained in an amount of from 0.5 to 10.0% by weight, Sn is contained in an amount of from 1.0 to 5.0% by weight, Zr is contained in an amount of from 1.5 to 6.0% by weight, Nb is contained in an amount of from 1.0 to 4.0% by weight, Cr is contained in an amount of from 1.0 to 7.0% by weight, and Mn is contained in an amount of from 1.0 to 6.0% by weight.

7. A sintered Ti alloy material as claimed in claim 1, wherein the content of said Mo is from 2.0 to 20.0% by weight.

8. A process for producing a sintered Ti alloy material comprising:

preparing mixed powder for sintering, said mixed powder for sintering comprising 50% by weight or more of Ti powder, and elemental powder or alloy powder of B and Mo containing from 0.1 to 8.0% by weight of B and from 2.0 to 30.0% by weight of Mo, with respect to a total content of 100%;

forming said mixed powder for sintering into a green compact;

sintering said green compact at a sintering temperature to form a sintered body; and forming the sintered Ti alloy material of claim 2.

9. A process for producing a sintered Ti alloy material as claimed in claim 8, wherein said sintering is conducted by using a liquid phase of Ti-Mo-B as a sintering accelerating phase to form said sintered body.

10. A process for producing a sintered Ti alloy material as claimed in claim 8, wherein said mixed powder for sintering further comprises at least one selected from the group consisting of Fe, Ni, Co, Cu, Al, V, Sn, Zr, Nb, Cr and Mn.

11. A process for producing a sintered Ti alloy material as claimed in claim 8, wherein one of cold working, warm working and hot working is conducted after said sintering.

12. A process for producing a sintered Ti alloy material as claimed in claim 8, wherein said mixed powder for sintering contains Fe and said Mo as alloy powder.

13. A process for producing a sintered Ti alloy material as claimed in claim 8, wherein at least one component constituting said mixed powder for sintering is added as a boride.

14. A process for producing a sintered Ti alloy material as claimed in claim 8, wherein the content of said Mo is from 3.0 to 20.0% by weight.

15. A process for producing a sintered Ti alloy material comprising:

preparing mixed powder for sintering, said mixed powder for sintering comprising Ti powder, and elemental powder or alloy powder of B and Mo;

forming said mixed powder for sintering into a green compact;

sintering said green compact at a sintering temperature to form a sintered body by using a liquid phase of Ti-Mo-B as a sintering accelerating phase; and forming the sintered Ti alloy material of claim 2.

* * * * *